US005867949A

United States Patent [19]

Untiedt

[11] Patent Number: 5,867,949

[45] Date of Patent: Feb. 9, 1999

[54] BUILDING STRUCTURE

[76] Inventor: Dalmain F. Untiedt, 5 Jellicoe Street, Rosebank, Johannesburg, Gauteng, South Africa

[21] Appl. No.: 761,646

[22] Filed: Dec. 6, 1996

[30] Foreign Application Priority Data

Dec. 6, 1995 [ZA] South Africa ..... 95/10342

[51] Int. Cl.[6] ..... E04B 7/02

[52] U.S. Cl. ..... 52/93.2; 52/90.1; 52/93.1; 52/282.1; 52/283; 52/300; 52/478

[58] Field of Search ..... 52/90.1, 93.2, 52/93.1, 282.1, 283, 300, 478

[56] References Cited

U.S. PATENT DOCUMENTS

| | | | |
|---|---|---|---|
| 25,414 | 4/1896 | Jones . | |
| 1,778,337 | 10/1930 | Pratt . | |
| 1,997,876 | 4/1935 | Sheldon . | |
| 2,539,038 | 1/1951 | Schumaker . | |
| 2,730,211 | 1/1956 | Findlay . | |
| 2,797,696 | 7/1957 | Fritsche . | |
| 3,221,467 | 12/1965 | Henkels . | |
| 3,222,040 | 12/1965 | Eckert . | |
| 3,274,739 | 9/1966 | Gregoire . | |
| 3,295,267 | 1/1967 | Lundell . | |
| 3,420,016 | 1/1969 | Findlay . | |
| 4,092,992 | 6/1978 | Huddle . | |
| 4,205,497 | 6/1980 | Schirm | 52/93.2 |
| 4,590,727 | 5/1986 | Gharemani et al. . | |
| 4,594,823 | 6/1986 | Hague | 52/90.1 |
| 4,926,605 | 5/1990 | Milliken et al. . | |
| 5,004,001 | 4/1991 | Bouchard . | |
| 5,044,131 | 9/1991 | Fisher . | |
| 5,117,598 | 6/1992 | Livingston et al. . | |
| 5,245,803 | 9/1993 | Haag | 52/90.1 |
| 5,365,705 | 11/1994 | Crowley et al. | 52/90.1 |
| 5,390,453 | 2/1995 | Untiedt | 52/90.1 |
| 5,600,924 | 2/1997 | Forsberg | 52/93.1 X |

*Primary Examiner*—Christopher Kent
*Attorney, Agent, or Firm*—Knobbe, Martens, Olson & Bear, LLP

[57] ABSTRACT

A building structure is provided having a combination of a support post with a beam having a generally triangular cross-sectional shape with outwardly directed longitudinally extending flanges at the base and a channel formed along the peak of the beam, roofing sheets on the beam which is supported by a support post which is a rolled rectangular cross sectioned sheet metal component each side of which has a centrally located longitudinally extending stiffening channel formed therein. There is also provided a wall plate between the post and the beam, the wall plate comprising a component rolled to generally channel cross-section one flange of which has an outwardly extending step terminating in a section extended parallel to the channel flanges, and for the flanges to be inclined to the web of the channel. The webs of the channel section of the wall plate has punched tongues projecting outwardly therefrom and which engage the flanges on the beam and the free end of the extended section terminates in a rolled glazing channel.

5 Claims, 4 Drawing Sheets

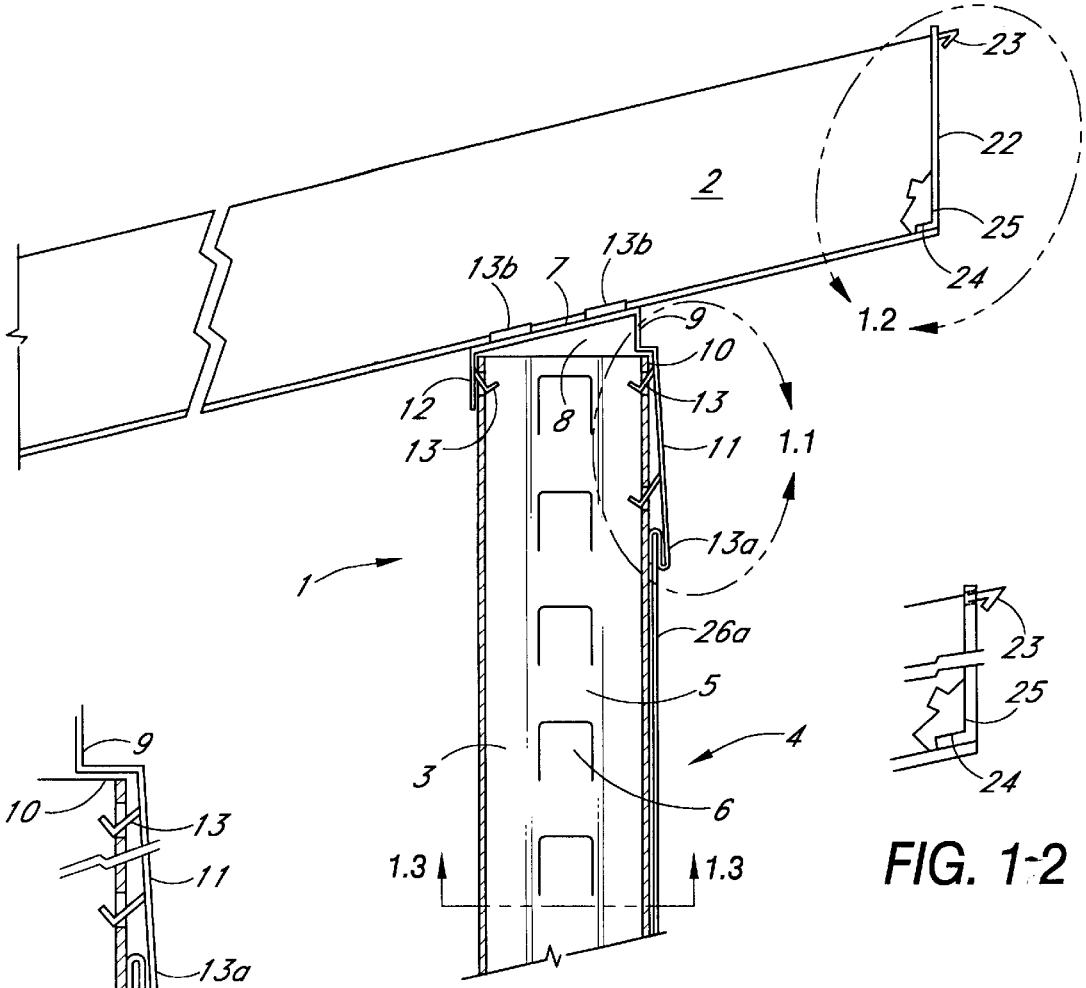
FIG. 1
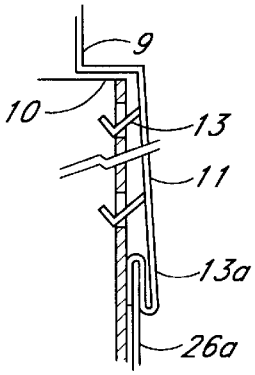
FIG. 1-1
FIG. 1-2
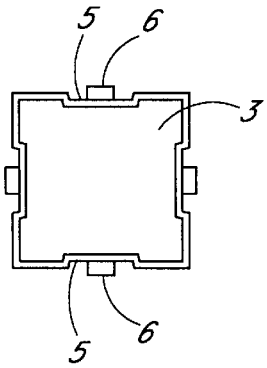
FIG. 1-3
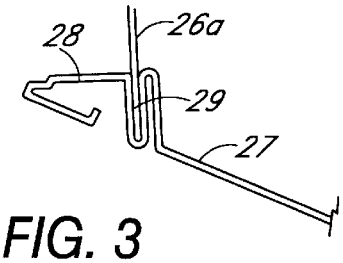
FIG. 3

BUILDING STRUCTURE

FIELD OF THE INVENTION

This invention relates to a building structure using a beam of the kind set forth in my U.S. Pat. No. 5,390,453 entitled "Structural members and structures assembled therefrom".

BACKGROUND OF THE INVENTION

The detailed disclosure of the beam described and claimed in the specification of my U.S. Pat. No. 5,390,453 is hereby incorporated by reference and detailed descriptions will not be repeated here. The beam is of generally triangular cross-sectional shape and has outwardly directed longitudinally extending flanges at the base while a channel is formed along the peak of the beam. Roofing sheets with downwardly bent hook-shaped ends engage in the channel which is shaped so that the hooked shaped ends cannot be easily retracted. Ceiling panels can be supported on the flanges and the beams are, in use, secured to wall plates, beams or supporting posts.

The beams are used to act as rafter frameworks and are particularly but not exclusively suited for low-cost housing using unskilled labor in the building of such housing. Nevertheless, the nature of the materials used for the components are such that care and some skill is required in the erection of building structures therefrom and it is the object of the present invention to provide means whereby not only is erection made easier but also efficiency and aesthetic appearance of the building improved.

SUMMARY OF THE INVENTION

According to this invention, there is provided a building structure comprising a combination of a support post with a beam having a generally triangular cross-sectional shape with outwardly directed longitudinally extending flanges at the base and a channel formed along the peak of the beam, roofing sheets on the beam which is supported by a support post which is a rolled rectangular cross-sectional sheet metal component, each side of which has a centrally located longitudinally extending stiffening channel formed therein.

A further feature of this invention provides for the post to have keying tongues punched from the web of each channel. The invention also provides for the combination to include a wall plate comprising a component rolled to generally channel cross-section one flange of which has an outwardly extending step terminating in a section extended parallel to the channel flanges, and for the flanges to be inclined to the web of the channel.

Still further features of this invention provide for the webs of the channel section of the wall plate to have punched tongues projecting outwardly therefrom and which engage the flanges on the beam and also for the free end of the extended section to terminate in a rolled glazing channel.

The invention also provides for the free ends of the flanges to have clips punched therefrom engaging the upper edges of the openings formed by the punching of the tongues from the sides of the posts.

Yet further features of this invention provides for the combination to include a gutter assembly comprising a channel section with one flange longer than the other which flange terminates in an inwardly directed lip engaging under a lip formed on the end of the roofing sheet and the web having a supporting bracket hooked into the base of a beam.

Also the free flange end is rolled to form a strengthening bead along the length of the gutter.

The combination may also include a fascia panel having oppositely directed flanges at each end inclined to the panel, one flange secured to the end of the base of the beam and the other engaged by a lip on the end of the roofing sheet.

Another feature of this invention provides for a glazing panel for a glass panel to be included in a structure providing a clear storey lighting arrangement, the glazing panel being rolled from sheet metal with one edge shaped to clip over a lip on the end of a roofing sheet and provide a glazing channel above and adjacent the end of the roofing sheet with the other end of the panel extending at an inclination away from the bottom of the glazing channel and located on the roofing sheet.

BRIEF DESCRIPTION OF THE DRAWINGS

These and other features of this invention will become apparent from the following descriptions of examples of the components, wherein reference is made to the accompanying drawings, in which:

FIG. 1 is a schematic cross-sectional view of an upper section of a building structure in one embodiment of the present invention, wherein a detail view at the left of the page (FIG. 1.1) is of the lower edge of the right extended vertical section of the wall plate; a detail view at the top right of the page (FIG. 1.2) is of a fascia panel attached at the right end of the beam; and a detail view at the lower right of the page (FIG. 1.3) is a cross-section of the post showing the stiffening channels;

FIG. 3 is a detail view of one embodiment of a glazing panel shown in FIG. 2;

DETAILED DESCRIPTION OF THE PREFERRED EMBODIMENT

As illustrated in FIGS. 1*a* to 5*a*, the structural member forms part of a roof structure which is suitable for use on low-cost housing with the roof being inclined in one direction only.

Figure 1A:
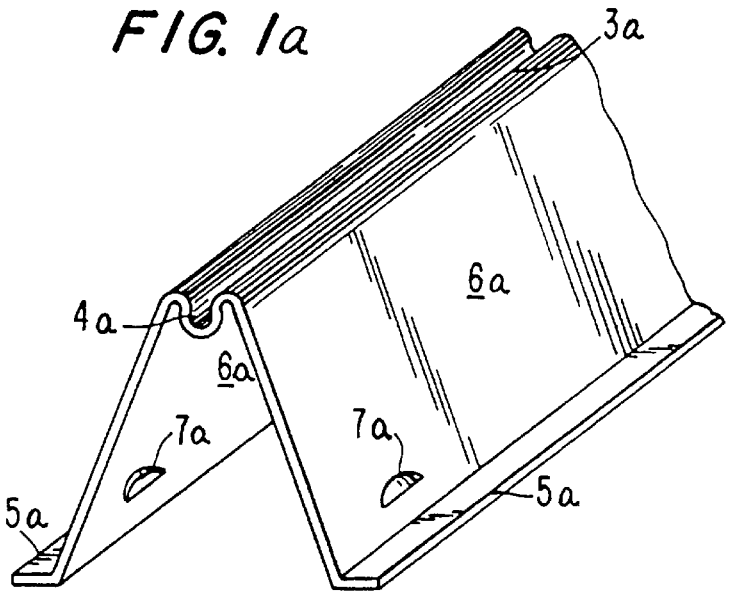
FIG. 1*a* shows an oblique view of an end of a rafter.

The structure has the structural member acting as rafters (2*a*) in FIG. 1*a*, each formed from rolled or pressed sheet metal to a generally triangular transverse cross-section. The peak (3*a*) of the rafter is formed to provide drip free channel (4*a*) extending along the length of the rafter. The base has outwardly extending flanges (5*a*) and the side walls (6*a*) of the rafter are inherently resiliently flexible towards each other.

Figure 3A:
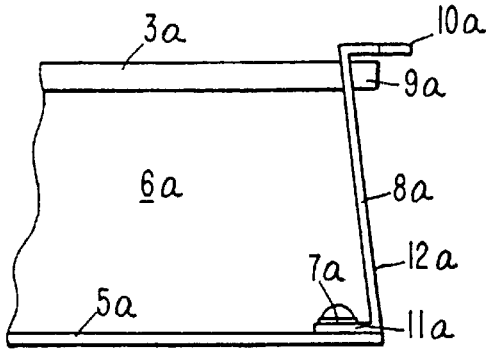
FIG. 3*a* illustrates the attachment of a facia panel.
Figure 4A:
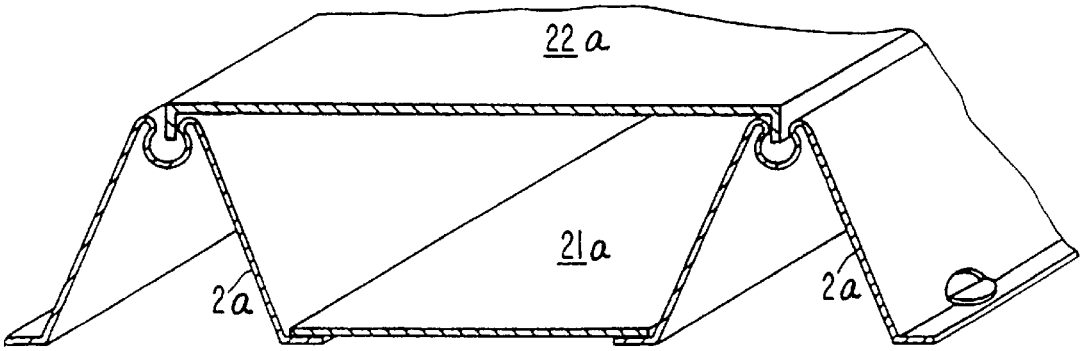
FIG. 4*a* shows a roof panel mounted between adjacent rafters.

Lugs (7*a*) are pressed outwardly from the material of the walls (6*a*) closely adjacent the flanges (5*a*). As shown in FIG. 3*a*, the ends of the rafters (2*a*) are shaped to receive facia panels (8*a*) and are inclined rearwardly from the base at the lower ends and forwardly at the higher ends. The channel (4*a*) at the peak projects beyond the end of the rafter to form a pintle (9*a*) which engages through an appropriate aperture formed in the facia panel (8*a*).

The facia panel (8*a*) is also formed from sheet metal bent to have oppositely directed flanges (10*a*) and (11*a*) along the top and bottom edges, respectively. To attach the panel (8*a*) to the ends of a series of rafters, all that is necessary is for the flange (11*a*) to be engaged between the flanges (5*a*) of the rafters (2*a*) and the lugs (7*a*) adjacent the ends of the rafters. The rafters can conveniently be rolled from individual lengths of sheet metal with the ends cut to provide the appropriate shape to receive the facia panel.

The pintles (9*a*) engage the appropriate apertures in the panel which is also provided with a series of ventilation openings (12*a*). Flange (10*a*) engages under the end of the roof panel.

The rafters (2*a*) are carried by supporting beams (13*a*) which in turn are secured to posts (14*a*). Preferably, the posts (14*a*) are slotted adjacent these upper ends as indicated at (15*a*) to receive the lower flange (16*a*) of the beam (13*a*) formed from sheet metal to channel section.

U-bolts (17*a*) can conveniently be used to secure the beams (13*a*) to posts (14*a*) and the use of wing nuts on the bolts will avoid the necessity for spanners or other tools to secure the beams.

It will be appreciated that the beams referred to could be wall plates fixed to the tops of walls instead of being carried by posts.

Referring to FIG. (2*a*), the underside of a rafter (2*a*) is shown engaged on a supporting beam (13*a*). The beam (13*a*) has pressed from what in use is its upper flange (18*a*) a pair of lugs (19*a*). The flanges (5*a*) on the rafter are resiliently engaged under the lugs (19*a*) by flexing the walls (6*a*) of the rafter (2*a*) towards each other to permit the flanges to engage under the lugs and then allowing the walls to flex outwardly to secure flanges (5*a*) under lugs (19*a*).

Once this has been done, a tongue (20*a*) of material from the flange (18*a*) is bent into the space between the walls (6*a*) until the tongue contacts the walls. The rafters (2*a*) are now locked to the beam (13*a*).

The location of the lugs (19*a*) on the supporting beams (13*a*) and the apertures for the U-bolts (17*a*) are predetermined and the beams prefabricated. This will ensure that the posts can be properly located and that the rafters (2*a*) will be exactly spaced apart and be at right angles to the beams (13*a*).

The pitch of the roof will be determined by the height of the posts at the respective ends of the rafters and a simple Jig can be provided to ensure the appropriate relationship.

From the above it will be seen that the erection of all the roof structure can be achieved without any sophisticated tools or labor. The configuration of the rafters and beams is such that high strength of the supporting structure can be achieved with a low weight of structural metal.

The flanges (5*a*) enable preformed panels (21*a*) of ceiling material to be inserted between the rafters (2*a*) with the panel sizes predetermined by the length and spacing of the rafter. The provision of an integral flange on the rafter and the use of cardboard or other inexpensive heat insulating material for the provision of ceilings at low cost for low-cost dwellings is a marked advantage over the roof structures presently available, and ceilings with an insulating air space or space including insulating material between ceiling and roof panels makes conditions within the dwelling far more comfortable than where ceilings cannot be provided. The ceilings also facilitate containment of services such as plumbing and electricity.

The roofing panels (22*a*) are also made from bent metal sheet to have downturned flanges around the edges. The longitudinal flanges on the panels (22*a*) are cut away at each end for a length equivalent to the length of the upper flange (10*a*) on the facia panels (8*a*).

With the support structure assembled as above described, all that is necessary is for the roofing panels (22*a*) to be mounted thereon. This is easily accomplished by engaging the transverse flanges against the edges of the flanges (10*a*) of the facia panels (8*a*) and the longitudinal flange in the channels (4*a*) extending along the peaks of the rafters.

It will be appreciated that the channels (4*a*) are made part-circular in transverse cross-section so that there is a narrow opening into which flanges on abutting roof panels are inserted. The opening is made to a size which will ensure firm frictional engagement between the edges of the channel openings and the flanges and between the flanges themselves. The channel also forms a drain along the length of the rafter.

Figure 5A:
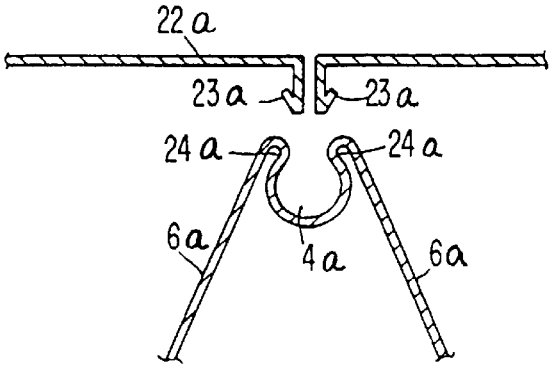
FIG. 5*a* is a detail.

Further it will be understood that the example above described may be modified to have the channel (4*a*) designed as shown in FIG. 5*a*to receive the longitudinal flanges on the roof panels (22*a*) illustrated in that figure. The ends (23*a*) of the flanges are bent to project upwardly and outwardly to engage under lips (24*a*) formed at the opening into the channel (4*a*). This will lock the panels onto the rafter.

The above example has been described with the flanges (5*a*) at the base of the rafter (2*a*) being directed outwardly. It will be clear that the rafter (2*a*) can have the flanges directed inwardly and the wall (6*a*) flexed outwardly to enable the flanges to engage under appropriately positioned preformed lugs pressed from the body of the material of the support beam. In this embodiment, a pair of tongues will be necessary, one on each side of the rafters, to provide the lock to prevent removal of the rafter.

Also under some circumstances, it will be possible to provide the rafter shaped as a triangular cross-section. The apex will have a longitudinally extending slot to engage flanges on roofing panels and the whole rafter will act as the drainage channel referred to above. This rafter will require a different form of fixing to that described for rafters having separate flanges at the base.

The surfaces of the components may all be treated before erection of the roof structure to provide any desired protective and decorative finish.

From the above it will be appreciated that the simple design of a roof structure comprises four components being a beam which may be a wall plate, rafter, roof sheet and facia plates. No bolts, nuts or screws are required, as all components clip and lock together forming a robust structure. The design separates the load bearing and covering function of materials resulting in substantial savings in costs of materials and erection. The roof structure is leakproof and provides attachment for insulation and ceilings.

Figure 2A:
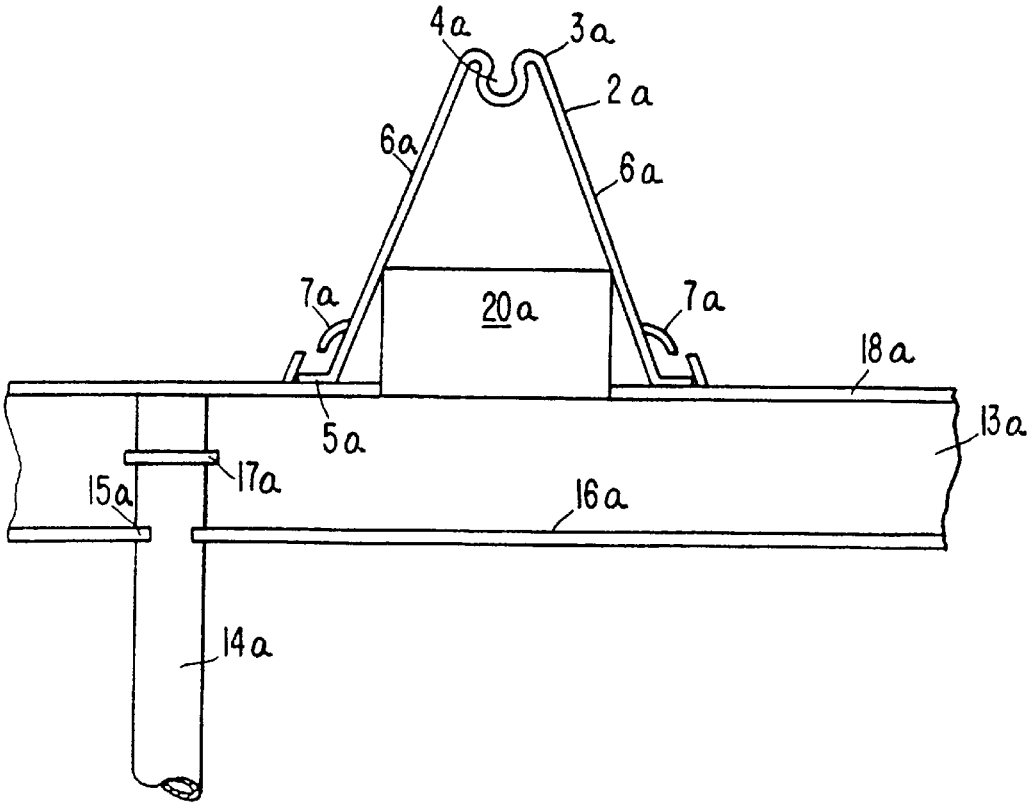
FIG. 2*a* shows an end view of the rafter engaged on a supporting beam.
Figure 2:
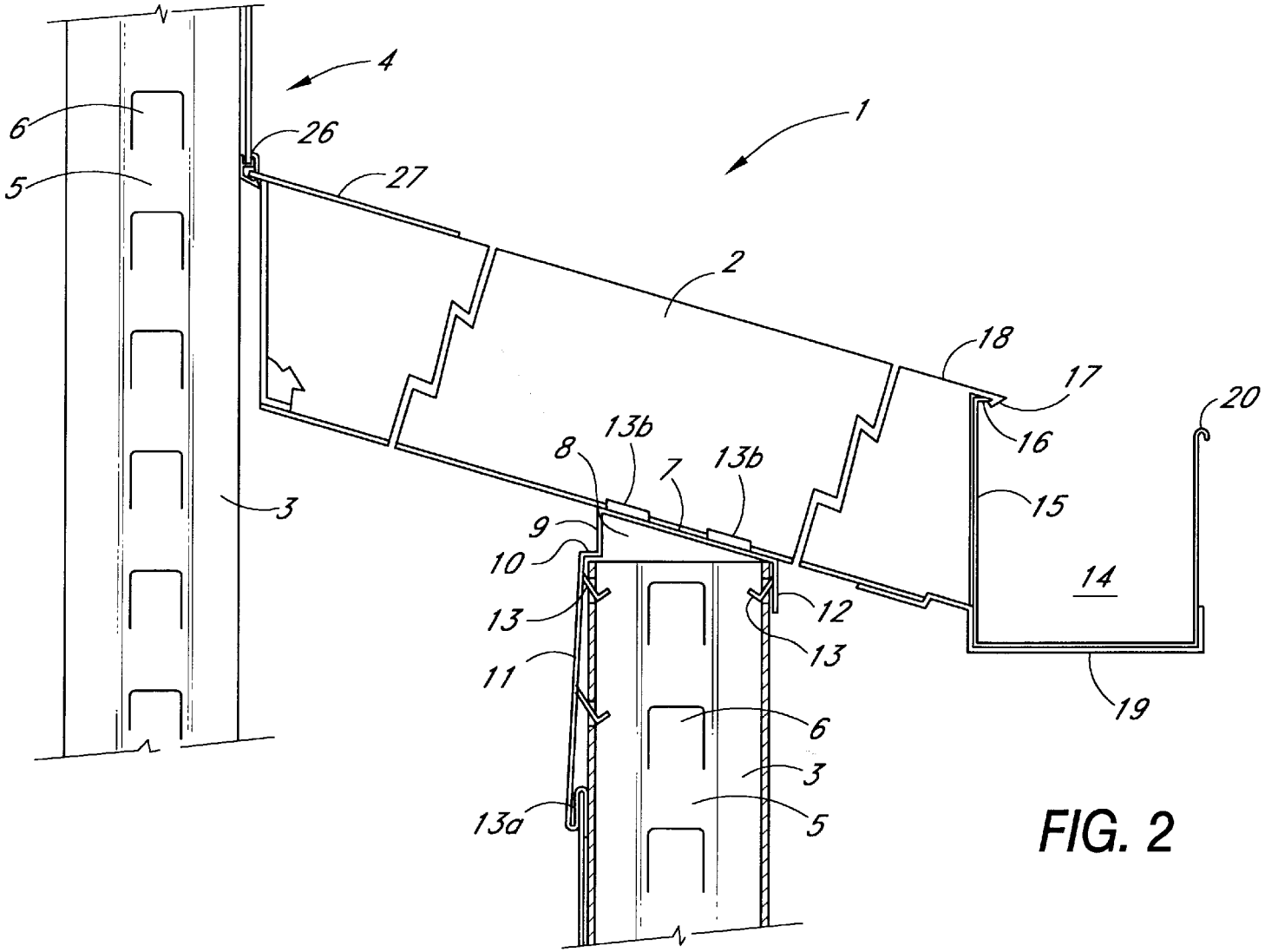
FIG. 2 is a schematic cross-sectional view of a section of the building structure of FIG. 1 adjoining below the upper section of FIG. 1, as shown at lines A—A.

As illustrated, the building structure indicated generally in FIGS. 1 and 2 shows an assembly of generally triangular cross-sectional shaped beams (2) as disclosed in U.S. Pat. No. 5,390,453, mounted on wall plates (1) which are themselves mounted on the ends of support posts (3) to provide a glazed storey lighting arrangement (4).

Each support post (3) has a transverse cross-section conforming to a rectangular and preferably square shape, each side of which has a centrally located longitudinally extending stiffening channel (5) formed therein. The post (3) is preferably rolled from light gauge steel sheet, with the abutting ends of the sheet secured down one corner.

A series of tongues (6) are punched from the web of each panel forming the posts(3).

The post (3) of the above design utilizes a high proportion of the intrinsic strength of the metal sheet from which it is used and is preferably designed to carry four times the weight of a module of the roof construction.

The tongues (6) are used to key brickwork, plastering and concrete to the posts.

An opening left by the punched tongue adjacent the top of the post is used to locate and secure tongues from a wall plate (7) reducing the risk of the roof being blown off during heavy wind conditions.

The wall plate (7) is a component also rolled from metal sheet. It has a generally channel cross-section (8) with one flange (9) having an outwardly extended step (10) terminating in a section (11) parallel to the channel flanges (12). The flanges are inclined to the web as shown to accommodate the required pitch of the beams (2) in the roof structure.

The wall plate (7) is designed to fit over the top of a wall and posts (3). This allows a good finish between the wall and ceiling to be obtained. The wall plate (7) could be designed to include a cornice if required.

By appropriately selecting the depth of the vertical section the wall plate can span different spaces between support posts (3) and become load bearing components between the parts of the wall plates positioned over support posts (3). This then allows the roof to be constructed first and the wall later. This procedure enables construction to proceed under the protection of the roof during inclement weather thereby improving productivity and reducing costs.

The space afforded by the channel (8) below the beam facilitates the location and fixing of timber frame or concrete panels and ensures that the wall is straight. The downwardly extending vertical parts of wall plates, being section (11) and flange (12) of channel (8) allow strategically placed clips (13) to be punched from the sheet metal. These clips (13) engage the upper edges of the openings adjacent the top support posts (3) left by the tongue (6) to secure the wall plate to the post.

To locate the beam (2) on the wall plate (7) keying tongues (13B) are pressed from the web of the channel (8) to engage the flanges projecting from the base of the beam (2). These lugs (13B) prevent lateral and longitudinal movement of the beam (2) relative to the post (3) and also retain the beams against lifting from the top of the posts.

By forming narrow reverse channels (13A) at the lower edge of the extended vertical sections (11) provision is made for glazing in the clear storey lighting situation illustrated. Substantial savings are made in that special window frames will not be required to retain the glass panes.

A gutter assembly for the roofing structure is indicated generally at (14). This provides a channel section with one flange (15) longer than the other. The flange (15) terminates in an inwardly directed lip (16) which engages under a lip (17) formed on the end of a roofing sheet (18).

The web of the channel is carried on a supporting bracket (19) which is securely hooked into the base of the beam (2).

A bead (20) is formed along the free end of flange (21) to strengthen the gutter. No bolts or other fastening devices are necessary.

The construction ensures that the gutter not only collects rain water from the roof but also closes the space between the roofing sheets (18) and ceiling panels (not shown) supported between adjacent beams (2) on the flanges of the beams as mentioned above. It also acts as a buttress for ceiling panels so that these panels do not have to be otherwise secured to the sloping beams (2).

The structure also includes a fascia panel (22) consisting of a sheet of metal having oppositely directed flanges (23) and (24) along the edges. These flanges are inclined to the panel (22). Flange (24) is secured to the end of the base of the beam (2) at (25) and flange (23) is engaged by the lip (17) on the end of the roofing sheet (18). During construction of a roof using beams of the kind referred to, difficulties are sometimes experienced in locating the roof sheets (18) over the beams (2) accurately and fixing the roof sheets (18) so that the ends are in line.

The light metal section fascia is placed onto the ceiling panel supporting flanges of the beam (2) and its base. The higher end butts against the peak of the beam. The roof sheets (18) are then hooked by means of lips (17) over the upper flanges (23) of the fascia (22), maneuvered to bring the roof sheet (18) over the support post (3) accurately and then clipped into the channel along the peak of the support beam (2) and secured. This is mentioned above and described in detail in U.S. Pat. No. 5,390,453.

The fascia (22) designed and utilized in this way has a multiple function. It facilitates the fixing of roof sheets. It helps align and stabilize the structure giving it added strength. Also, it closes off the space between roof and ceiling and it enhances the appearance of the roof.

To retain the bottom edges (26) of the glass panes (26A) of the clear storey lighting a glazing panel (27) is provided. As shown in FIG. 3 on an enlarged scale, the panel (27) is rolled from sheet metal to have one edge (28) shaped to clip over the lip (17) on a roofing sheet (18).

A glazing channel (29) is formed adjacent the clip-shaped edge with the channel (29) directed upwardly to receive the bottom edge (26) of the glass panel. The remaining portion of panel (27) extends at an inclination following that of the roofing sheet (18).

The panel (27) thus also acts as flashing preventing the ingress of rain into the building.

The invention thus provides a plurality of components interacting to facilitate erection of a roofing structure and provide increased strength and functionability to the assembly as well as resulting in an improved aesthetic appearance.

The embodiments described above are provided merely to illustrate the present invention. Changes and modifications may be made from the embodiments presented herein by those skilled in the art without departure from the spirit and scope of the invention, as defined by the appended claims.

What I claim as new and desire to secure by Letters Patent is:

1. A building structure, comprising a plurality of beams extending substantially parallel to one another and having a generally triangular cross-sectional shape to provide a longitudinally extending peak, an inwardly extending channel with an opening at and extending along the peak, and a base for securing said beam, said base comprising flanges extending longitudinally along said beam and extending outwardly therefrom and roofing sheets on said beams extending between adjacent beams and adapted to engage said channels therein, and a plurality of posts, supporting said beams, each of which is formed from a rolled sheet metal into an elongate member having four longitudinally extending sides forming a substantially rectangular cross-section, each side of said post having a substantially centrally located, longitudinally extending stiffening channel formed therein, wherein the post has been punched to form a series of keying tongues in each of said stiffening channels.

2. A building structure comprising a plurality of beams extending substantially parallel to one another and having a generally triangular cross-sectional shape to provide a longitudinally extending peak, an inwardly extending channel with an opening at and extending along the peak, and a base for securing said beam, said base comprising flanges extending longitudinally along said beam and extending outwardly therefrom and roofing sheets on said beams extending between adjacent beams and adapted to engage said channels therein, and a plurality of posts, supporting said beams, each of which is formed from a rolled sheet metal into an elongate member having four longitudinally extending sides forming a substantially rectangular cross-section, each side of said post having a substantially centrally located, longitudinally extending stiffening channel formed therein, a wall plate located between the post and the beam, the wall plate comprising two side walls joined by a base wall to form a member having a generally channel shaped cross-section, said side walls being substantially parallel to one another and inclined to said base wall, one of said side walls extending into a flange portion which has a step portion extending outwardly with respect to said one side wall and terminating in a section extended substantially parallel to said side walls.

3. A building structure as claimed in claim 2, in which the base wall of the wall plate has punched tongues projecting outwardly therefrom and which engage the flanges on the base on the beam, said extended section having a free end terminating in a portion rolled upwardly and then downwardly to form a generally S-shaped cross section having a channel opening downwardly to receive a window pane.

4. A building structure as claimed in claim 2, in which said roofing sheets form a roof edge, said structure further comprises a gutter assembly at one end of the beams and comprising first and second side walls joined by a base wall to form a channel for receiving rain and the like, said first side wall extending upwardly and terminating in a lip projecting inwardly toward said channel said lip engaging said roof sheets adjacent said edge under said sheets to retain said gutter assembly in place.

5. A building structure as claimed in claim 4, in which the free end of the said second side wall is rolled to form a strengthening bead along the length of the gutter.

* * * * *